US008513596B2

(12) United States Patent
Kang et al.

(10) Patent No.: US 8,513,596 B2
(45) Date of Patent: Aug. 20, 2013

(54) APPARATUS FOR ELECTROSPRAY IONIZATION AND METHOD FOR ELECTROSPRAY IONIZATION USING THE SAME

(75) Inventors: Duk Jin Kang, Chungcheongbukdo (KR); Myoung Choul Choi, Seoul (KR); Jong Shin Yoo, Daejeon (KR); Hyun Sik Kim, Daejeon (KR)

(73) Assignee: Korea Basic Science Institute (KR)

( * ) Notice: Subject to any disclaimer, the term of this patent is extended or adjusted under 35 U.S.C. 154(b) by 143 days.

(21) Appl. No.: 13/318,287

(22) PCT Filed: Dec. 23, 2010

(86) PCT No.: PCT/KR2010/009254

§ 371 (c)(1),
(2), (4) Date: Oct. 31, 2011

(87) PCT Pub. No.: WO2011/081352

PCT Pub. Date: Jul. 7, 2011

(65) Prior Publication Data

US 2012/0049082 A1 Mar. 1, 2012

(30) Foreign Application Priority Data

Dec. 29, 2009 (KR) ..... 10-2009-0132875

(51) Int. Cl.
*H01J 49/26* (2006.01)
*H01J 49/14* (2006.01)
*H01J 49/10* (2006.01)

(52) U.S. Cl.
USPC ..... 250/283; 250/288; 250/423 R; 250/425

(58) Field of Classification Search
USPC ..... 250/281–283, 288, 396 R, 423 R, 250/424, 425
See application file for complete search history.

(56) References Cited

U.S. PATENT DOCUMENTS

| | | | | |
|---|---|---|---|---|
| 5,157,260 | A | 10/1992 | Mylchreest | |
| 5,756,994 | A * | 5/1998 | Bajic | 250/288 |
| 7,145,136 | B2 * | 12/2006 | Yang et al. | 250/288 |
| 8,003,935 | B2 * | 8/2011 | Robinson et al. | 250/288 |
| 2006/0131497 | A1 * | 6/2006 | Yang et al. | 250/288 |
| 2012/0199732 | A1 * | 8/2012 | Chetwani et al. | 250/282 |

FOREIGN PATENT DOCUMENTS

| | | | |
|---|---|---|---|
| JP | 09210964 | A | 8/1997 |
| WO | WO2009048739 | A2 | 4/2009 |

OTHER PUBLICATIONS

"Analysis of Protein Sequence Using High Performance Liquid Chromatography Electrospray Ionization Tandem Mass Spectrometry (HPLC-ESI-MS/MS)". Saengwhahak nyusu 15(4), 225-231, 1995. See pp. 225-226 and figures 1-3.

* cited by examiner

*Primary Examiner* — Bernard E Souw
(74) *Attorney, Agent, or Firm* — Jansson Munger McKinley & Shape Ltd.

(57) ABSTRACT

An apparatus for electrospray ionization may include: a platform including an inlet port, a first channel connected to the inlet port, a second channel connected to the first channel, and an outlet port connected to the second channel; a nebulizer provided in the first channel and configured to spray inert gas to a sample sprayed into the first channel through the inlet port; and a focusing lens provided in the second channel and configured to focus ions produced from the sprayed sample toward the outlet port.

13 Claims, 8 Drawing Sheets

APPARATUS FOR ELECTROSPRAY IONIZATION AND METHOD FOR ELECTROSPRAY IONIZATION USING THE SAME

TECHNICAL FIELD

Embodiments relate to an apparatus for electrospray ionization (ESI) and a method for ESI using the same.

BACKGROUND ART

In the field of bioscience and medicine, a systematic analysis of disease-related proteins is required for treatment and prevention of diseases. With the advancement in basic researches for drug discovery in molecular biology and genomics, the territory of drug discovery is changing rapidly and new methods are being developed for drug discovery as exemplified by the genomic drug discovery.

Also, in the field of bioscience and medicine including development of new drugs, identification of materials exhibiting physiological activities for specific diseases or under specific conditions is required. Since those biologically active substances are mostly proteins, elucidation of structures and functions of the proteins is of crucial importance.

Since the analysis of proteins is very complicated because of their various characteristics associated with molecular weight, isoelectric point (pI), hydrophilic or hydrophobic nature, or the like, it is needed to first separate the proteins and identify them based on mass spectrometry, bioinformatics, etc. Considering that the proteins related with diseases exist in relatively lower quantities than other proteins, high-performance protein separation techniques and low detection limits for the separated proteins are needed.

The electrospray ionization (ESI) technique was first introduced in 1984. Thermally unstable biochemical substances such as proteins, peptides and sugars are unsuited for structural analysis and characteristic study by gas chromatography-mass spectrometry (GC-MS).

For separation and fractionation of those thermally unstable biochemical substances, high-performance liquid chromatography (HPLC) is widely employed. For structural analysis of various biochemical substance separated by HPLC as well as qualitative and quantitative analysis, the biochemical substances dissolved in a solution are converted into charged ions by means of ESI and then injected into a mass spectrometer. Then, the mass spectrometer performs structural analysis through mass measurement of the injected ions using mass spectrometry (MS) spectrums and tandem spectrums (MS/MS spectrums).

The most frequently employed method for sample ionization by ESI is to inject the biochemical substances such as proteins or peptides eluted using a microsyringe pump or an HPLC pump capable of microflow rate control into a capillary emitter having an inner diameter of several to tens of micrometers (e.g. about 1 μm to about 20 μm). Then, by directly injecting heated nitrogen gas (e.g., to about 100° C. to about 300° C.) to the outlet port of the capillary emitter while applying a high voltage thereto, desolvation of the droplet formed by the electrospray is facilitated and ionization is enhanced.

However, since the nitrogen gas is injected directly to the capillary emitter, the capillary emitter may be shaken or the ions produced by the electrospray may be diffused. As a result, the movement of charged ions through the inlet port of the mass spectrometer may be affected.

DISCLOSURE OF INVENTION

Technical Problem

An aspect of the present invention is directed to providing an apparatus for electrospray ionization (ESI) capable of focusing ions produced by ESI to minimize diffusion thereof while taking advantage of a nebulizer using heated nitrogen gas, and a method for ESI using the same.

Solution to Problem

According to an embodiment, an apparatus for electrospray ionization (ESI) may include: a platform including an inlet port, a first channel connected to the inlet port, a second channel connected to the first channel, and an outlet port connected to the second channel; a nebulizer provided in the first channel and configured to spray inert gas to a sample sprayed into the first channel through the inlet port; and a focusing lens provided in the second channel and configured to focus ions produced from the sprayed sample toward the outlet port.

According to an embodiment, a method for ESI may be performed using the apparatus for ESI and may include: spraying the sample into the first channel through the inlet port; spraying the inert gas to the sprayed sample using the nebulizer; and focusing the ions produced from the sprayed sample toward the outlet port using the focusing lens.

Advantageous Effects of Invention

An apparatus for electrospray ionization (ESI) according to an aspect of the present invention may be used as an ESI source kit for liquid chromatography-mass spectrometry (LC-MS). In that case, the apparatus for ESI may be used for structural analysis and biochemical study of protein mixtures extracted from human blood or cells and peptide mixtures acquired from enzymatic processes in proteomic researches.

In particular, when applied for structural analysis or qualitative and quantitative analysis of various proteins related with human diseases, the apparatus for ESI exhibits improved ionization efficiency and lower limit of detection (LOD) for mass spectrometry as compared to the conventional ESI techniques. Accordingly, it may be utilized for exploration of biomarkers related with human diseases and top-down proteomic researches allowing structural study in protein level.

BRIEF DESCRIPTION OF DRAWINGS

The above and other aspects, features and advantages of the disclosed exemplary embodiments will be more apparent from the following detailed description taken in conjunction with the accompanying drawings in which.

MODE FOR THE INVENTION

Figure 1:
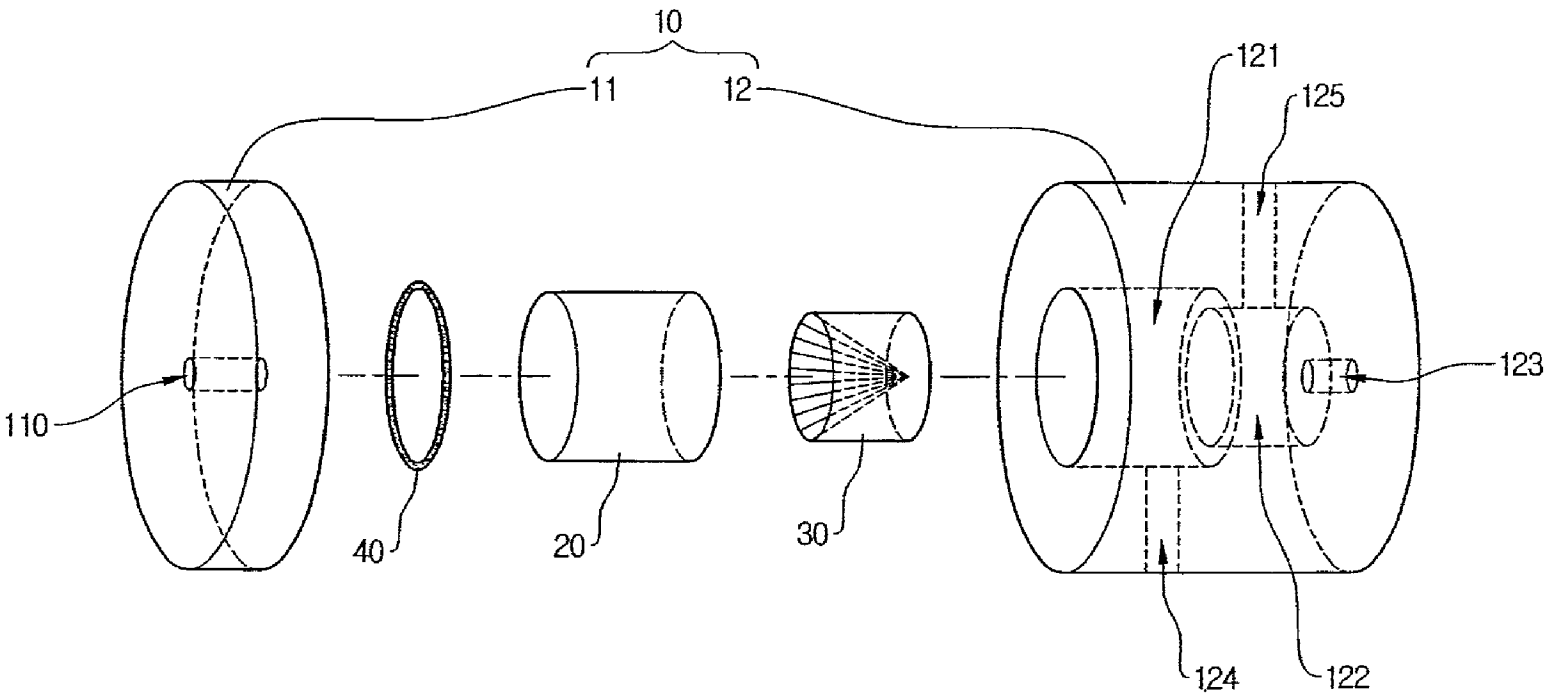
FIG. 1 is an exploded perspective view of an apparatus for electrospray ionization (ESI) according to an embodiment.

Exemplary embodiments now will be described more fully hereinafter with reference to the accompanying drawings, in which exemplary embodiments are shown. This disclosure may, however, be embodied in many different forms and should not be construed as limited to the exemplary embodiments set forth therein. Rather, these exemplary embodiments are provided so that this disclosure will be thorough and complete, and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second" and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals denote like elements. The shape, size and regions, and the like, of the drawing may be exaggerated for clarity.

Figure 2:
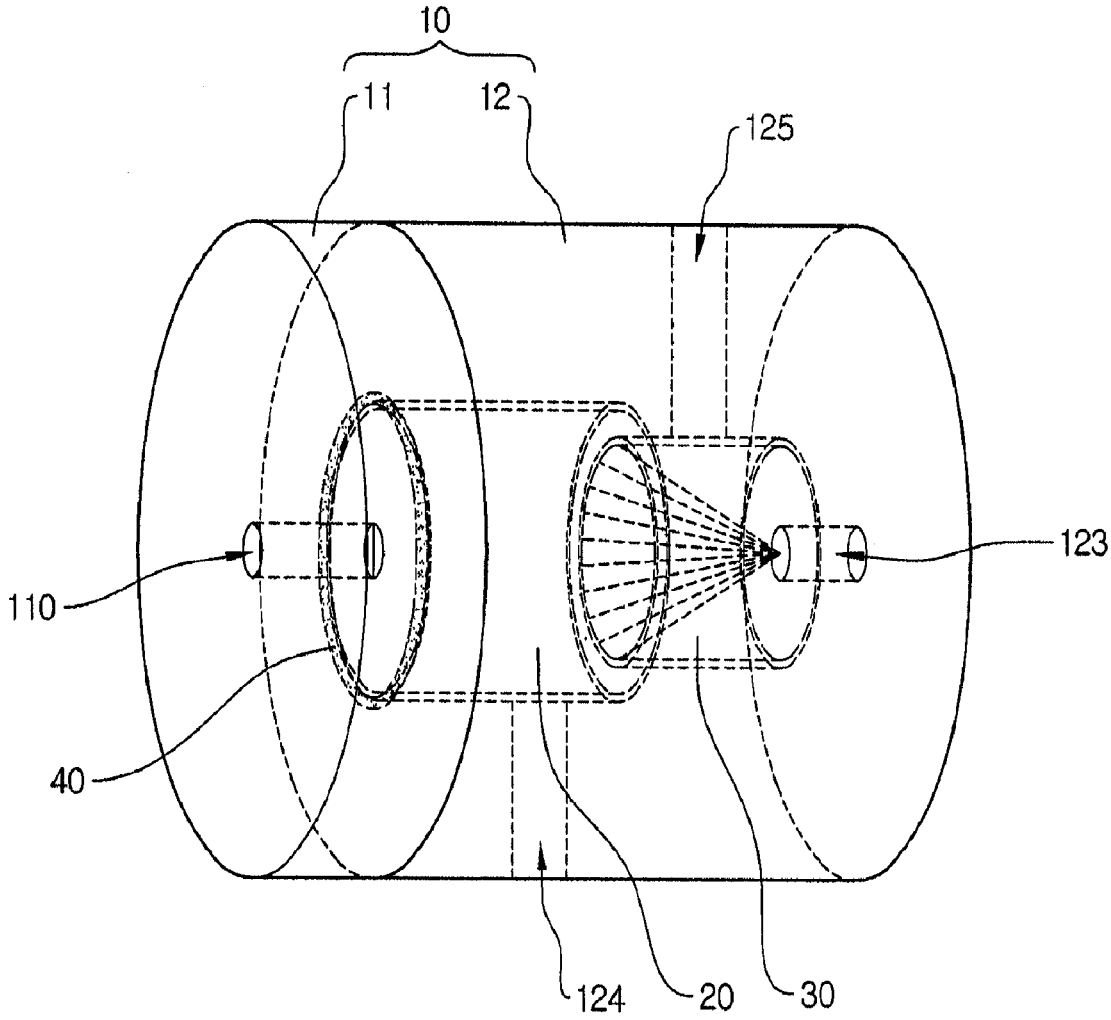
FIG. 2 is a perspective view of an apparatus for ESI according to an embodiment.

FIG. 1 is an exploded perspective view of an apparatus for electrospray ionization (ESI) according to an embodiment, and FIG. 2 is a perspective view showing an assembled state of the apparatus for ESI illustrated in FIG. 1.

Referring to FIG. 1 and FIG. 2, an apparatus for ESI may comprise: a platform 10 comprising a first block 11 and a second block 12; and a nebulizer 20 and a focusing lens 30 provided in the platform 10. In an embodiment, the apparatus for ESI may further comprise a rubber ring 40 provided between the nebulizer 20 and the first block 11 of the platform 10 to prevent gas leakage.

The platform 10 serves as a body to fix the position of the nebulizer 20 and the focusing lens 30 in the apparatus for ESI. The platform 10 may be made of any processable material. For example, the platform 10 may be formed of acryl. The platform 10 may have a cylindrical shape, and the first block 11 and the second block 12 may also have cylindrical shapes. However, this is only exemplary, and the platform 10 may have other appropriate shapes in other embodiments.

The first block 11 of the platform 10 may have an inlet port 110. The inlet port 110 is the portion where a liquid sample is injected into the platform 10 for ESI. The inlet port 110 may completely penetrate the first block 11. The sample may be various biochemical substances in liquid state, including proteomes, peptides or other macro-molecules. The sample may be injected into the platform 10 while a high voltage is applied for ESI.

The inlet port 110 may be formed to be connected to, for example, a capillary emitter or a nanoflow capillary column through which the sample is transferred. For example, the inlet port 110 may be formed such that a 1/16-inch male nut and/or a 1/16-inch ferrule available from Upchurch Scientific, Inc., which is commonly used to join tubings when forming a flow pathway in high-performance liquid chromatography (HPLC), may be coupled therewith. However, the type of the inlet port 110 is not limited thereto, but may be determined appropriately depending on the shapes and types of the connection parts.

The second block 12 of the platform 10 may have a first channel 121, a second channel 122 and an outlet port 123. Through, for example, a tubing equipped at the inlet port 110 of the first block 11, the sample may be injected into the first channel 121. The first channel 121 is a space for fixing the nebulizer 20, and the second channel 122 is a space for fixing the focusing lens 30. The first channel 121, the second channel 122 and the outlet port 123 may completely penetrate the second block 12.

In an embodiment, the second block 12 may have one or more first hole(s) 124 connected from outside to the first channel 121 for injection of inert gas to the nebulizer 20. The first hole 124 may be formed such that a 1/8-inch male nut and/or a 1/8-inch ferrule available from Upchurch Scientific, Inc. may be coupled therewith, but without being limited thereto. And, in an embodiment, the second block 12 may have a second hole 125 connected to the second channel 122 for electrical connection of the focusing lens 30 with outside.

By positioning the nebulizer 20 and the focusing lens 30 respectively in the first channel 121 and the second channel 122 of the second block 12 and then coupling the second block 12 with the first block 11 using, for example, a bolt, the apparatus for ESI according to an embodiment may be set up. Details about the shapes of the first block 11 and the second block 12 and the coupling of the first block 11 and the second block 12 will be described later referring to FIGS. 3, 4, 5 and 6.

As described, the nebulizer 20 may be located in the first channel 121 of the second block 12. When the sample is sprayed into the first channel 121 through, for example, a tubing equipped at the inlet port 110, the sample may become droplets with a size of tens to hundreds of micrometers. As the nebulizer 20 sprays heated inert gas to the area where the sample is sprayed, solvents are removed from the droplets (desolvation) and only sample ions remain. For example, the nebulizer 20 may be configured to spray nitrogen gas heated to about 100° C. to about 300° C., but without being limited thereto.

If there is a void space at the portion where the nebulizer 20 is coupled with the second block 12, movement of gas may be non-uniform. Accordingly, in order to minimize non-uniform gas movement, the outside portion of the nebulizer 20 may be sealed with Teflon, silicone or other suitable materials, so that no space is formed between the nebulizer 20 and the inside surface the second block 12. Further, in an embodiment, the rubber ring 40 may be inserted between the nebulizer 20 and the first block 11 to prevent gas leakage.

The nebulizer 20 may be made of stainless steel. And, the nebulizer 20 may have a cylindrical shape. However, this is only exemplary, and the nebulizer 20 may be made of other suitable materials and/or have other appropriate shapes.

The focusing lens 30 may be located in the second channel 122 of the second block 12. The focusing lens 30 is a device for focusing the sample ions generated when the sample sprayed into the first channel 121 meets the heated inert gas sprayed by the nebulizer 20 toward the outlet port 123. That is to say, the focusing lens 30 may serve to prevent spreading of the multiple charged ions of the biochemical substance produced by ESI.

In an embodiment, the focusing lens 30 may have a conical shape for efficient collection of diffused ions. When the focusing lens 30 has a conical shape, the portion where the ions are injected may be relatively wider for easier collection of the diffused ions, and the portion where the ions are discharged may be relatively narrower for easier focusing of the ions. For example, the focusing lens 30 may have a diameter of about 7 mm at the inlet portion and a diameter of about 2 mm at the outlet portion. The focusing lens 30 may be made of stainless steel.

However, the material and shape of the focusing lens 30 are not limited to those described above. The focusing lens 30 may be made of other conducting materials such as metal and may have other shapes allowing focusing of the ions.

The focusing lens 30 may focus the sample ions using a potential gradient. The potential gradient formed by the focusing lens 30 may be selected adequately depending on the polarity of the sample ions produced by ESI. For example, if the sample ions are positively (+) charged ions, a positive (+) potential gradient may be formed at the focusing lens 30. And, if the sample ions are negatively (−) charged ions, a negative (−) potential gradient may be formed at the focusing lens 30. It may be configured such that a voltage applied to the focusing lens 30 may be controllable.

For this, the focusing lens 30 may be electrically connected to an external power supply (not shown). For example, a conducting wire may be connected between the focusing lens 30 and the external power supply through the second hole 125 of the second block 12. For example, the end portion of the conducting wire may be drawn by about 2 mm to about 3 mm inward the second channel 122 of the second block 12 and fixed, and then the focusing lens 30 may be inserted in the second channel 122, so as to connect the conducting wire to the focusing lens 30. The presence of impurities in the second block 12 may cause difficulties in positioning the focusing lens 30, and thus, the second block 12 may be cleaned to remove the impurities before connecting the conducting wire to the focusing lens 30.

By providing the nebulizer 20 with a cylindrical shape in the cylindrical platform 10 as describe above, a uniform nitrogen gas flow may be provided and the nitrogen gas flow may be focused toward the capillary emitter. Since the nitrogen gas is distant from the capillary emitter, shaking of the capillary emitter by the nitrogen gas flow may be minimized. Further, since the voltage-controllable focusing lens 30 for preventing diffusion of and focusing the ions produced by ESI is provided before the capillary emitter, the ionized samples may be easily focused and injected to a mass spectrometer.

Figure 3:
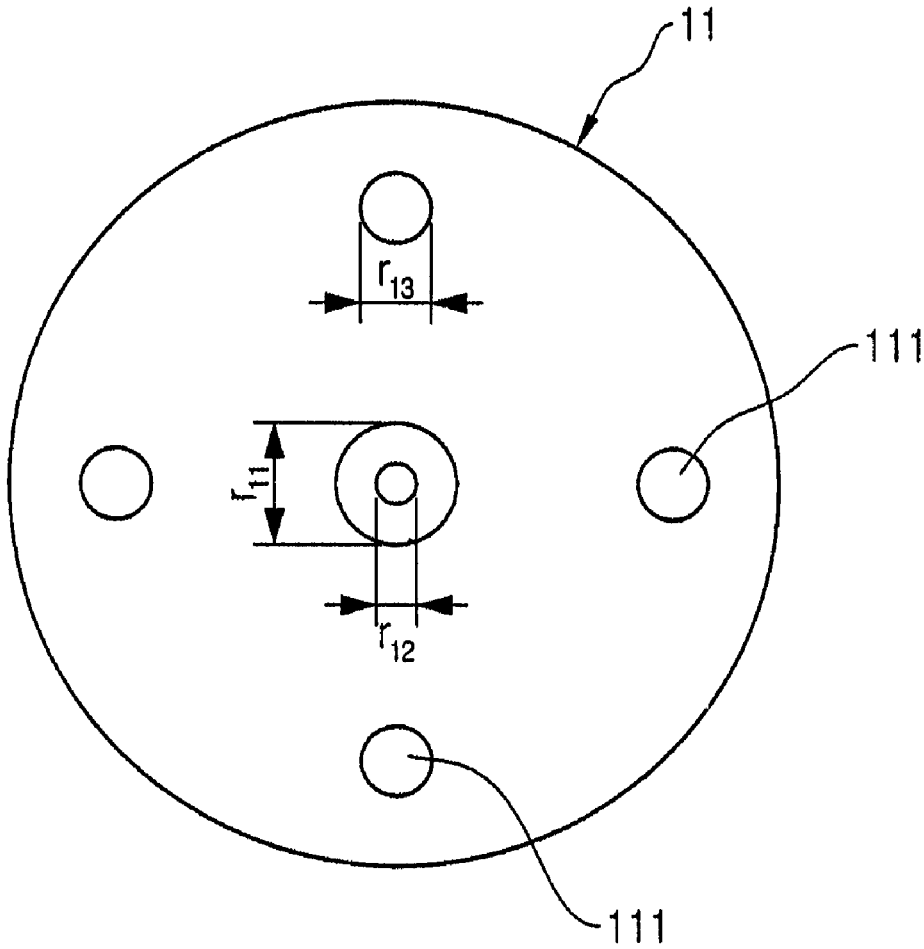
FIG. 3 is a plan view of a first block constituting a platform of an apparatus for ESI according to an embodiment.
Figure 4:
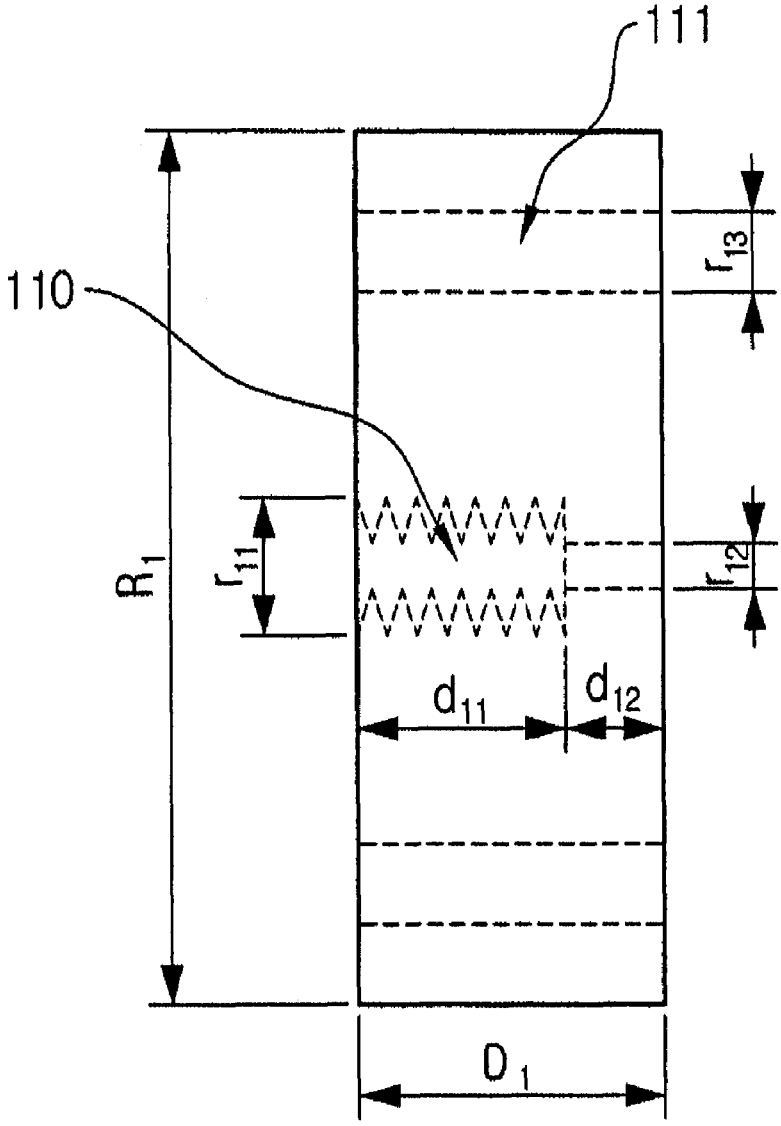
FIG. 4 is a side cross-sectional view of a first block constituting a platform of an apparatus for ESI according to an embodiment.

FIG. 3 is a plan view of the first block 11 of the platform 10 of an apparatus for ESI according to an embodiment, and FIG. 4 is a side cross-sectional view of the first block 11 of the platform 10 of an apparatus for ESI according to an embodiment.

Referring to FIGS. 3 and 4, the first block 11 may be in the form of a cylinder with a diameter $R_1$ of about 42 mm and a thickness $D_1$ of about 15 mm. The first block 11 may have the inlet port 110 for coupling and fixing with, for example, a capillary emitter or a nanoflow capillary column.

The inlet port 110 may have a spiral shape with an outer diameter $r_{11}$ of about 6.2 mm, an inner diameter $r_{12}$ of about 1.8 mm and a depth $d_{11}$ of about 10 mm, so that a 1/16-inch male nut or a 1/16-inch ferrule may be coupled therewith. The remaining portion of the inlet port 110 except for the spiral structure may have a depth $d_{12}$ of about 5 mm. The inlet port 110 may completely penetrate the first block 11.

Figure 5:
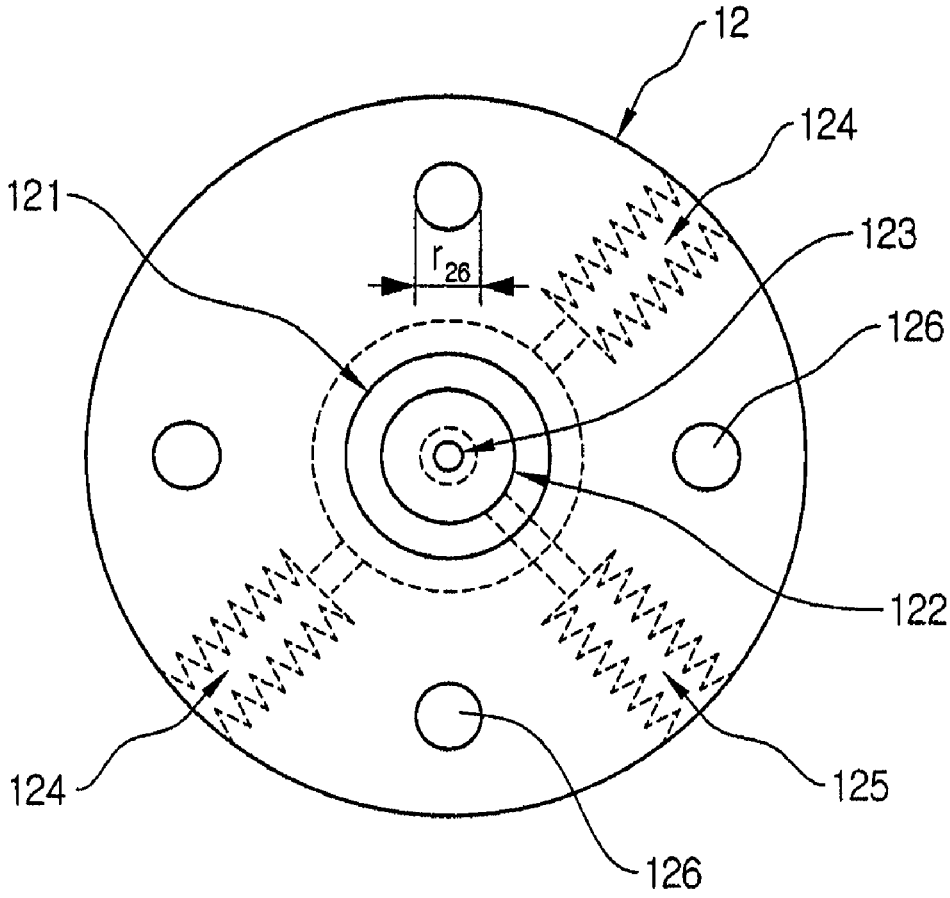
FIG. 5 is a plan view of a second block constituting a platform of an apparatus for ESI according to an embodiment.
Figure 6:
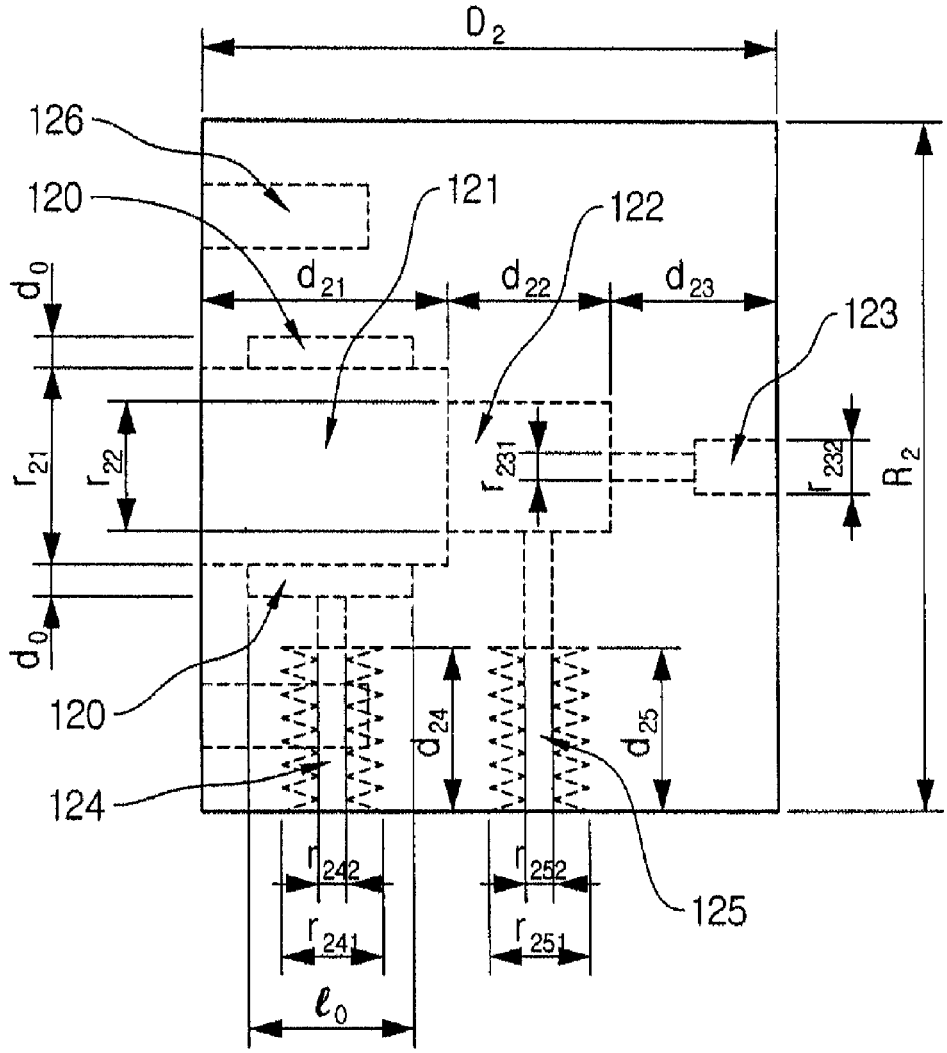
FIG. 6 is a side cross-sectional view of a second block constituting a platform of an apparatus for ESI according to an embodiment.

The first block 11 may have one or more coupling port(s) 111 for connection with the second block 12 (see FIGS. 5 and 6). For example, the first block 11 may have four coupling ports 111 located at four apices of a square. The first block 11 may be coupled with the second block 12 by inserting a bolt in each coupling port 111. Each coupling port 111 may have a diameter $r_{13}$ of about 4 mm. However, the shape and number of the coupling ports 111 may be different from those described above. Also, the first block 11 and the second block 12 may be coupled differently, not using the coupling ports 111.

FIG. 5 is a plan view of the second block 12 of the platform 10 of an apparatus for ESI according to an embodiment, and FIG. 6 is a side cross-sectional view of the second block 12 of the platform 10 of an apparatus for ESI according to an embodiment.

Referring to FIGS. 5 and 6, the second block 12 may be in the form of a cylinder with a diameter $R_2$ of about 42 mm and a thickness $D_2$ of about 35 mm. The diameter $R_2$ of the second block 12 may be the same as the diameter $R_1$ of the first block 11. The second block 12 may have the first channel 121, the second channel 122 and the outlet port 123. The first channel 121, the second channel 122 and the outlet port 123 may be sequentially connected and may completely penetrate the second block 12.

The first channel 121 may be a cylindrical space formed with a depth $d_{21}$ of about 15 mm from the surface of the second block 12. The first channel 121 may have a cross-sectional diameter $r_{21}$ of about 12 mm. The first channel 121 is a space for providing the nebulizer. The shape and size of the first channel 121 described are only exemplary, and may be determined appropriately according to the nebulizer used.

In an embodiment, the second block 12 may further have one or more gas circulation chamber(s) 120 connected to the first channel 121 and provided outside the circumference of the first channel 121. The gas circulation chamber 120 is provided to allow smoother movement of the inert gas sprayed by the nebulizer in the first channel 121, and may be formed with a thickness $d_0$ of about 2 mm and a length $l_0$ of about 10 mm outward the first channel 121.

The second channel 122 may be connected with the first channel 121 at the end portion of the first channel 121. The second channel 122 may be a cylindrical space formed with a depth $d_{22}$ of about 10 mm from the portion where the first channel 121 ends. The cross-sectional diameter $r_{22}$ of the second channel 122 may be smaller than the cross-sectional diameter $r_{21}$ of the first channel 121. For example, the second channel 122 may have a cross-sectional diameter $r_{22}$ of about 8 mm.

The outlet port 123 may be connected to the second channel 122 at the end portion of the second channel 122. The outlet port 123 may be a space formed with a depth $d_{23}$ of about 10 mm from the portion where the second channel 122 ends. The outlet port 123 may have a two-stage structure with a cross-sectional diameter $r_{231}$ of about 1 mm at a predetermined portion close to the second channel 122 and a cross-sectional diameter $r_{232}$ of about 3 mm at the remaining portion close to the surface of the second block 12. However, the shape of the outlet port 123 is not limited thereto. For example, in another embodiment, the outlet port 123 may have a cylindrical shape with one cross-sectional diameter.

In an embodiment, the second block 12 may have the one or more first hole(s) 124 for connection of the first channel 121 with outside. For example, the one or more first hole(s) 124 may be formed to penetrate the second block 12 from the side surface of the second block 12 to the first channel 121. The one or more first hole(s) 124 is the portion for injecting the inert gas to the nebulizer, which will be provided in the first channel 121. In case the second block 12 has the gas circulation chamber 120, each of the first holes 124 may be connected to the gas circulation chamber 120.

Also, in an embodiment, the second block 12 may have the second hole 125 for connection of the second channel 122 with outside. For example, the second hole 125 may be formed to penetrate the second block 12 from the side surface of the second block 12 to the second channel 122. The second hole 125 is the portion for electrical connection with the focusing lens, which will be provided in the second channel 122. The focusing lens may be electrically connected with the external power supply by inserting a conductor in the second hole 125.

Further, in an embodiment, the second block 12 may have one or more coupling port(s) 126 for connection with the first block 11. For example, the second block 12 may have four coupling ports 126 located at four apices of a square. The first block 11 may be coupled with the second block 12 by inserting a bolt in each coupling port 126. Each coupling port 126 may have a diameter $r_{26}$ of about 4 mm. However, the shape and number of the coupling ports 126 are not limited thereto.

In an embodiment, the first hole 124 and the second hole 125 may have spiral shapes with outer diameters $r_{241}$ $r_{251}$ of about 6.2 mm, inner diameters $r_{242}$, $r_{252}$ of about 1.8 mm and depths $d_{24}$, $d_{25}$ of about 10 mm from the side surface of the second block 12. In the embodiment illustrated in FIGS. 5 and 6, the first hole 124 and the second hole 125 have the same spiral shape. However, this is only exemplary, and the first hole 124 and the second hole 125 may have different structures.

In the first block 11 and the second block 12 described referring to FIGS. 3, 4, 5 and 6, the inlet port 110 of the first block 11 and the first hole 124 and the second hole 125 of the second block 12 are formed such that a tubing may be coupled therewith using, for example, a 1/16-inch male nut or a 1/16-inch ferrule available from Upchurch Scientific, Inc. Further, a 1/16-inch sleeve with an inner diameter of about 380 μm, which is available from Upchurch Scientific, Inc., may be used to prevent gas leakage during assemblage of the connection parts. However, these are only exemplary, and the configuration of the inlet port 110, the first hole 124 and the second hole 125 may be different depending on the type of the connection parts.

Figure 7:
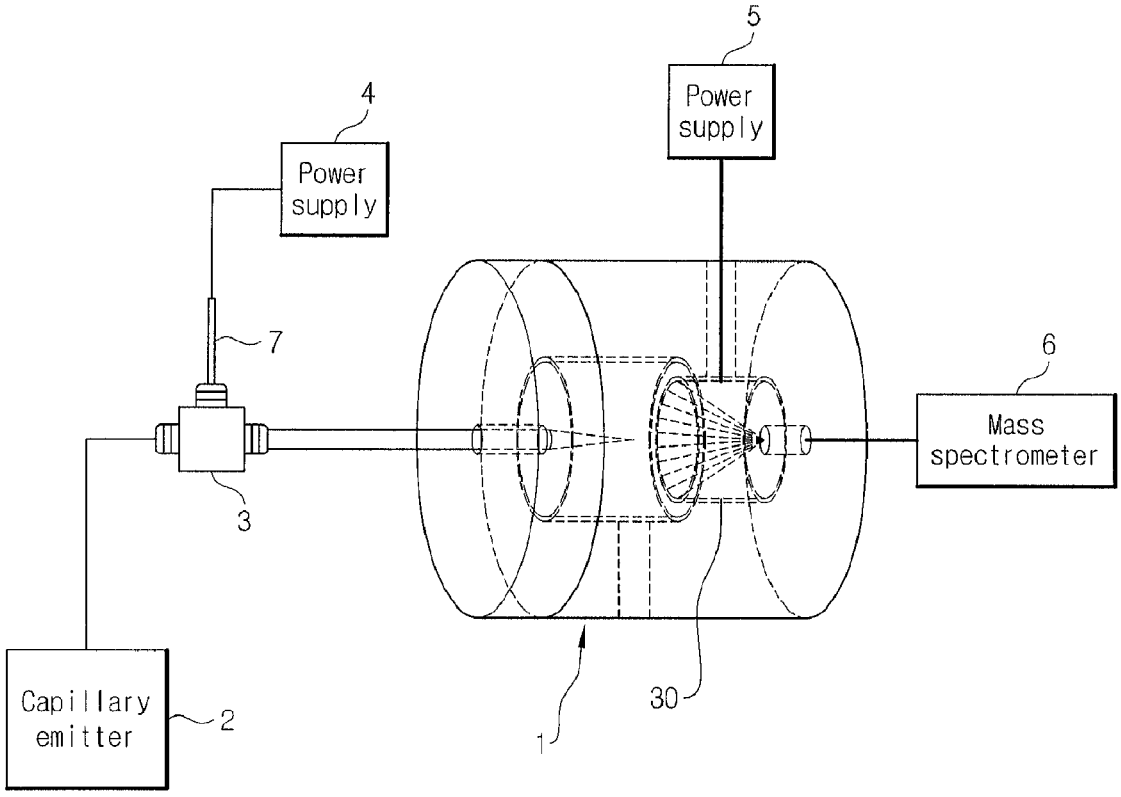
FIG. 7 is a schematic view illustrating connection of an apparatus for ESI according to an embodiment to an introducing part of a mass spectrometer.

FIG. 7 is a schematic view illustrating connection of an apparatus for ESI according to an embodiment to an introducing part of a mass spectrometer. For the brevity of explanation, details of the features that may be easily understood by those skilled in the art from the existing art will be omitted.

Referring to FIG. 7, a capillary emitter 2 transferring a liquid sample may be connected to a micro-T 3, for example, using a silica capillary having an outer diameter of about 360 μm. Between the capillary emitter 2 and the micro-T 3, a microsyringe pump or a micro HPLC pump (not shown) for pumping the sample may be provided.

The micro-T 3 may be connected to a power supply 4 to apply a voltage to the sample transferred from the capillary emitter 2. For example, the micro-T 3 may be electrically connected to the power supply 4 for application of a high voltage using a platinum (Pt) wire 7. The power supply 4 may apply a voltage of about 1.5 kV to about 2.0 kV to the Pt wire 7 connected to the micro-T 3 for ESI. However, this voltage is only exemplary, and the amplitude of the voltage may be different depending on, for example, the sample composition and/or flow rate.

The sample to which the voltage is applied using the micro-T 3 may be injected into an apparatus 1 for ESI through, for example, a silica capillary. When the sample is sprayed into the apparatus 1 for ESI, heated inert gas may be sprayed to the area where the sample is sprayed so as to remove a solvent from sample droplets and allow only sample ions to remain. Then, the apparatus 1 for ESI may focus the ions using a focusing lens 30 and inject them to a mass spectrometer 6. For example, the apparatus 1 for ESI may focus the ionized sample to an inlet orifice of the mass spectrometer 6. The focusing lens 30 may be electrically connected to a power supply 5. The power supply 5 may apply a voltage of about 50 V to about 300 V to the focusing lens 30.

The mass spectrometer 6 is operated using the two power supplies 4, 5. The power supplies 4, 5 are respectively electrically connected to the Pt wire 7 of the micro-T 3 and the focusing lens 30 of the apparatus 1 for ESI so as to apply a controllable high voltage. Ground electrodes of the power supplies 4, 5 may be grounded to the inlet orifice of the mass spectrometer 6 where the ionized sample is injected.

The mass spectrometer 6 performs structural analysis of the sample through mass measurement of the sample ions injected from the apparatus 1 for ESI using mass spectrometry (MS) spectrums and tandem spectrums (MS/MS spectrums). Details about the configuration and operation of the mass spectrometer 6 will be omitted since they are well known to those skilled in the art.

The above configuration where the apparatus 1 for ESI is applied in the introducing part of the mass spectrometer 6 may be applied in an ESI source kit for liquid chromatography-mass spectrometry (LC-MS). In particular, the apparatus 1 for ESI may be used for proteomic researches employing HLPC and mass spectrometer.

Figure 8:
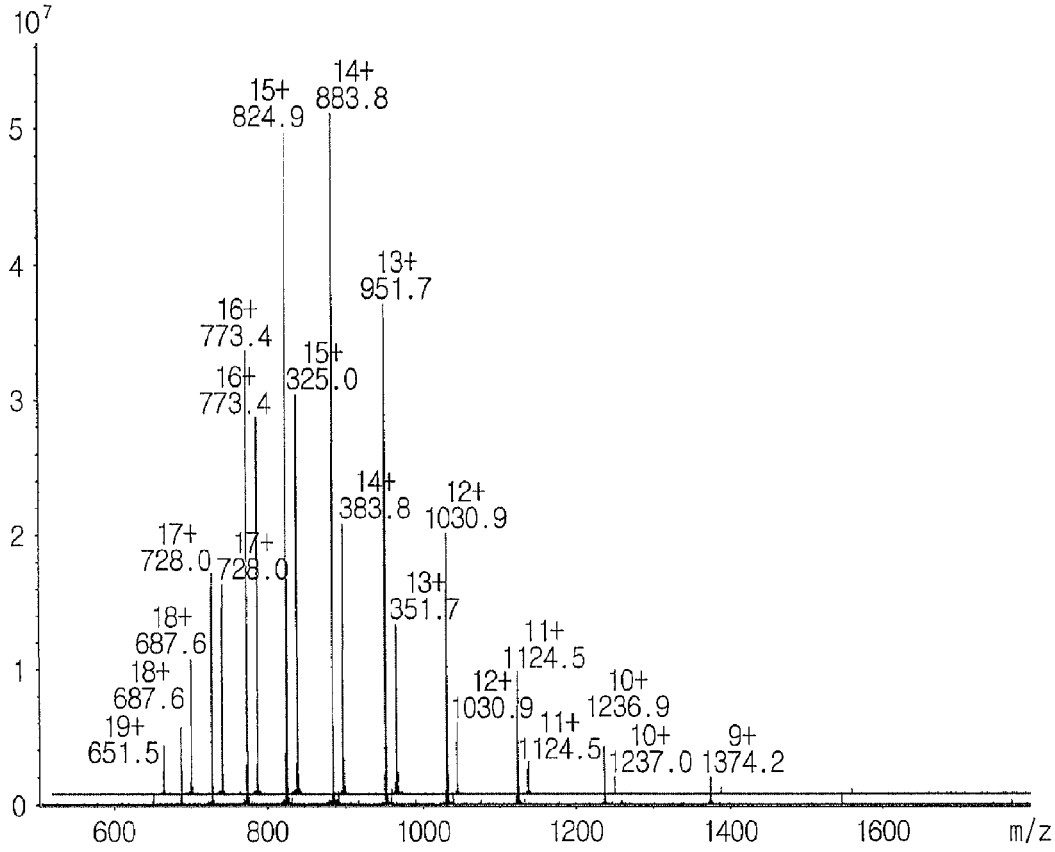
FIG. 8 compares a mass spectrometry spectrum obtained using an apparatus for ESI according to an embodiment with one obtained according to the related art.

FIG. 8 compares a mass spectrometry spectrum obtained using an apparatus for ESI according to an embodiment with one obtained according to the related art.

FIG. 8 shows the mass spectrometry spectrums of cytochrome c (about 12.4 kDa) as standard protein, obtained by diluting with a 50:50 (v/v) mixture of methanol containing about 0.2% formic acid and water ($H_2O$) to a concentration of 10 fmol and performing ESI at a flow rate of about 0.5 μm/min using a microsyringe pump. A Fourier transform ion cyclotron resonance (FT-ICR) mass spectrometer operating at a magnetic field of about 15 T was used.

In FIG. 8, peaks 610 and 620 are those of the multiple charged ions of cytochrome C obtained according to the related art and according to an embodiment of this disclosure, respectively. In both cases, cytochrome C was injected into a capillary emitter at a rate of about 0.5 μm/min and ESI was carried out by applying a voltage of about 1.7 kV. However, in the case where the apparatus for ESI according to an embodiment was used, nitrogen gas was injected from the nebulizer at a rate of about 0.2 L/min to remove the solvent and a positive (+) voltage of about 50 V was applied to the focusing lens.

As seen from FIG. 8, when the apparatus for ESI according to an embodiment was used, a detection sensitivity of about 2 times was exhibited for the $[M+14H^+]^{14+}$ ion having a mass-to-charge ratio (m/z) of about 883.8 as compared to the related art case. The detection sensitivity of the multiple charged ions increased gradually as the number of hydrogen ions decreased, starting from the $[M+16H^+]^{16+}$ ion formed by 16 hydrogen ions and having a mass-to-charge ratio of about 773.4. Overall, the apparatus for ESI according to an embodiment showed significantly improved ionization efficiency over the related art.

While the exemplary embodiments have been shown and described, it will be understood by those skilled in the art that various changes in form and details may be made thereto without departing from the spirit and scope of this disclosure as defined by the appended claims.

In addition, many modifications can be made to adapt a particular situation or material to the teachings of this disclosure without departing from the essential scope thereof. Therefore, it is intended that this disclosure not be limited to the particular exemplary embodiments disclosed as the best mode contemplated for carrying out this disclosure, but that this disclosure will include all embodiments falling within the scope of the appended claims.

INDUSTRIAL APPLICABILITY

Embodiments relate to an apparatus for electrospray ionization (ESI) and a method for ESI using the same.

The invention claimed is:

1. An apparatus for electrospray ionization comprising:

a platform comprising an inlet port, a first channel connected to the inlet port, a second channel connected to the first channel, and an outlet port connected to the second channel;

a nebulizer provided in the first channel and configured to spray inert gas to a sample sprayed into the first channel through the inlet port; and a focusing lens provided in the second channel and configured to focus ions produced from the sprayed sample toward the outlet port.

2. The apparatus for electrospray ionization according to claim 1, further comprising a capillary emitter connected to the inlet port and configured to spray the sample into the first channel.

3. The apparatus for electrospray ionization according to claim 1, wherein the platform further comprises a gas circulation chamber connected to the first channel and provided outside the first channel.

4. The apparatus for electrospray ionization according to claim 3, wherein the platform further comprises a first hole connected to the gas circulation chamber from outside.

5. The apparatus for electrospray ionization according to claim 1, wherein the platform further comprises a second hole connected to the second channel from outside.

6. The apparatus for electrospray ionization according to claim 5, further comprising:

a power supply; and a conductor electrically connecting the power supply with the focusing lens through the second hole.

7. The apparatus for electrospray ionization according to claim 1, wherein the platform further comprises:

a first block comprising the inlet port; and a second block comprising the first channel, the second channel and the outlet port.

8. The apparatus for electrospray ionization according to claim 7, wherein each of the first block and the second block has at least one coupling port for coupling the first block and the second block with each other.

9. The apparatus for electrospray ionization according to claim 7, further comprising a rubber ring provided between the first block and the nebulizer.

10. The apparatus for electrospray ionization according to claim 1, wherein the platform is formed of acryl.

11. The apparatus for electrospray ionization according to claim 1, wherein the nebulizer and the focusing lens are formed of stainless steel.

12. A method for electrospray ionization using an apparatus for electrospray ionization comprising: a platform comprising an inlet port, a first channel connected to the inlet port, a second channel connected to the first channel, and an outlet port connected to the second channel; a nebulizer provided in the first channel and configured to spray inert gas to a sample sprayed into the first channel through the inlet port; and a focusing lens provided in the second channel and configured to focus ions produced from the sprayed sample toward the outlet port, comprising:

spraying the sample into the first channel through the inlet port;

spraying the inert gas to the sprayed sample using the nebulizer; and focusing the ions produced from the sprayed sample toward the outlet port using the focusing lens.

13. The method for electrospray ionization according to claim 12, wherein focusing the ions toward the outlet port comprises applying a voltage to the focusing lens.

* * * * *